United States Patent [19]

Dais et al.

[11] 4,026,074

[45] May 31, 1977

[54] GRINDING WHEEL TUBULAR SUPPORT FOR RADIAL EXPANSION THEREOF

[75] Inventors: William F. Dais, Utica; Antoni J. Malarz, Warren, both of Mich.

[73] Assignee: General Motors Corporation, Detroit, Mich.

[22] Filed: June 4, 1976

[21] Appl. No.: 692,974

[52] U.S. Cl. ..... 51/168

[51] Int. Cl.[2] ..... B24B 41/04

[58] Field of Search ..... 51/168, 206 R, 206.4, 51/206.5

[56] References Cited

UNITED STATES PATENTS

| | | | |
|---|---|---|---|
| 2,755,605 | 7/1956 | Simmons | 51/168 |
| 2,909,014 | 10/1959 | Walking | 51/168 |

FOREIGN PATENTS OR APPLICATIONS

| | | | |
|---|---|---|---|
| 218,695 | 11/1966 | U.S.S.R. | 51/168 |

*Primary Examiner*—Al Lawrence Smith
*Assistant Examiner*—Nicholas P. Godici
*Attorney, Agent, or Firm*—Robert M. Sigler

[57] ABSTRACT

In a grinding wheel assembly of the type having a massive rotating grinding wheel with an inner axial bore subject to expansion with rotation, a tubular support member provides support between the axial bore and support bearing means. The tubular member has an inner central surface in engagement with a race of the bearing means, an outer central surface spaced from the axial bore and outer axial end surfaces shrunk fit into the axial ends of the bore to provide for relative expansion between the wheel and the bearing means.

1 Claim, 2 Drawing Figures

GRINDING WHEEL TUBULAR SUPPORT FOR RADIAL EXPANSION THEREOF

SUMMARY OF THE INVENTION

This invention relates to large massive wheels which are rotatably driven at high speeds and therefore subject to expansion from centrifugal forces, and in particular to large grinding wheels.

Large, massive rotating bodies are subject to centrifugal expansionary forces when rotated at high speeds, the expansion from which can cause those bodies to loosen from their central bearing supports. In the case of a large, multi-station grinding wheel, such looseness can lead to unacceptable inaccuracies in the grinding operation. It is essential that such a grinding wheel rotate with a stable, unchanging axis throughout the grinding operation.

This invention provides a deformable adapter between the central bearing means and the main body of the wheel which maintains firm engagement therebetween during high speed rotation of the grinding wheel. This adapter comprises a tubular member having an inner central surface adapted to engage the bearing means and an outer surface adapted to engage the wheel only at the tubular member's opposite axial ends. The tubular member is shrunk fit within the wheel so that its axial ends are compressed inwardly and will thus maintain contact with the wheel during centrifugal expansion.

Further details and advantages of this invention will be apparent from the accompanying drawings and following description of a preferred embodiment.

DESCRIPTION OF A PREFERRED EMBODIMENT

Figure 1:
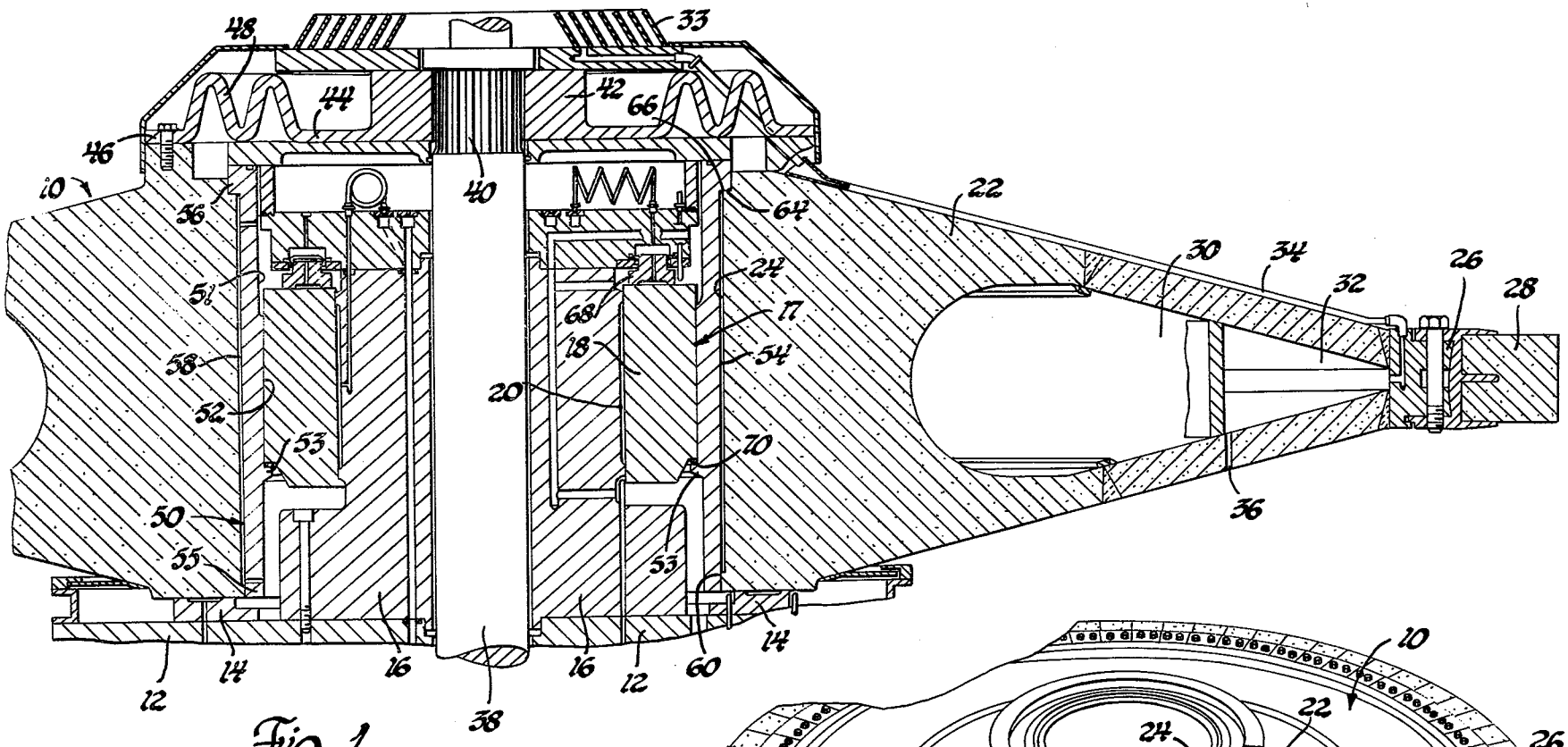
FIG. 1 shows a side cutaway view of a portion of a grinding wheel according to this invention.

Referring to FIG. 1, a large grinding wheel 10 is supported upon a horizontal base 12 by an annular compressed fluid bearing 14. An inner race 16 of another compressed fluid bearing 17 projects upward from base 12 centrally of and coaxial with wheel 10. An outer race 18 of bearing 17 surrounds inner race 16 with a fluid space 20 therebetween.

Grinding wheel 10 comprises a main body 22 with an inner bore 24 and an outer circumferential adapter 26 to hold the grinding segments 28. The main body 22 of wheel 10 may be constructed of metal or fiber reinforced composite and, to reduce unnecessary weight, contains a hollow core 30. Core 30 provides space for a plurality, 6 in this embodiment, of outer centrifugal compartments 32 which may be selectively provided with water through distributor 33 and feed conduits 34 to trim the balance of wheel 10 during rotation. Drains 36, effective when wheel 10 stops rotation, are provided for compartments 32.

A central power shaft 38 projecting upward from base 12 is splined at its upper end 40. A driving member 42 splined to upper end 40 of shaft 38 has a plurality of radially extending arms 44, the outer ends 46 of which are bolted to the main body 22 of wheel 10. A portion 48 of each arm 44 may be "accordian"-folded to allow for expansion of wheel 10. Power is supplied from motor means, not shown, through power shaft 38 and driving member 42 to rotate grinding wheel 10.

Grinding wheel 10 is secured to outer race 18 by a tubular member 50. Tubular member 50 has an inner radial surface 51, the axially central portion 52 of which is raised to engage outer race 18. In this embodiment, a flange 53 is provided at the bottom surface 52. Tubular member 50 also defines a radially outer surface 54, the lower and upper axial ends 55 and 56 of which engage the inner bore 24 of wheel 10 and the central portion 58 of which is spaced from inner bore 24. The latter mentioned spacing may be accomplished by raising portions of the radial outer surface 54 or inner bore 24 at the upper and lower axial ends. In this embodiment, inner bore 24 is provided with a raised lower axial end 60 while radially outer surface 54 of tubular member 50 is provided with the raised upper axial end 56.

Tubular member 50 defines an upper flange 64 which separates the raised upper axial end 56 and central portion 58 of radially outer surface 54. Flange 64 also engages a lip 66 in inner bore 24. A compressed fluid bearing 68 exerts a downward pressure on outer race 18, a portion 70 of which bears downward against flange 53 of tubular member 50. Tubular member 50, in turn, presses downward with flange 64 against lip 66 of grinding wheel 10; and the wheel 10 is thus held firmly in the vertical direction between bearings 14 and 68.

Figure 2:
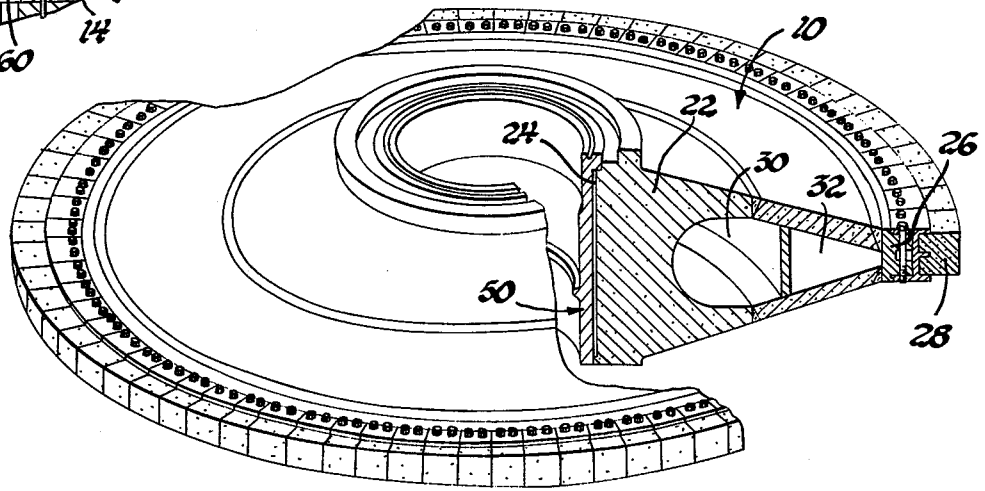
FIG. 2 shows a partially cutaway perspective view of a grinding wheel according to this invention.

During assembly of the grinding wheel apparatus, the tubular member 50 is given a shrink fit into inner bore 24 of wheel 10, as shown in FIG. 2. Thus tubular member 50 is somewhat compressed at its upper and lower axial ends until wheel 10 is rotated at high speed, at which time these axial ends spring back, still maintaining tight contact with the inner bore 24 and between surface 52 and outer race 18. The stability of the axis of rotation of wheel 10 is thus preserved during high speed rotation.

The embodiment shown and described herein is the preferred embodiment of this invention, but not the only embodiment that will occur to those skilled in the art. Therefore this invention should be limited only by the claim which follows.

What is claimed is:

1. In a grinding wheel assembly of the type having a massive rotating grinding wheel with an axial bore surface defining an axial bore and being subject to radial expansion during grinding wheel rotation, the assembly further having means for rotatably supporting and driving the grinding wheel including bearing means within the axial bore, the improvement comprising:

a tubular support member in the axial bore for supporting the grinding wheel on the bearing means, the tubular support member surrounding the bearing means and having an inner radial surface, the axially central portion of which engages the bearing means, the tubular support member further having a radially outer surface, the axially central portion of which is spaced from the axial bore and the axial ends of which are shrunk-fit into compressed engagement with the axial bore surface to expand and thus maintain engagement therewith as the axial bore expands during grinding wheel rotation.

* * * * *